US005752849A

United States Patent [19]

Orlando

[11] Patent Number: 5,752,849

[45] Date of Patent: May 19, 1998

[54] TOOL-LESS PHONE JACK-TO-CABLE CONNECTOR

[75] Inventor: Maurice V. Orlando, Longboat Key, Fla.

[73] Assignee: Ortronics, Inc., Pawcatuck, Conn.

[21] Appl. No.: 758,961

[22] Filed: Dec. 2, 1996

[51] Int. Cl.[6] ..... H01R 4/24

[52] U.S. Cl. ..... 439/412; 439/676

[58] Field of Search ..... 439/412, 411, 439/414, 404, 676, 344, 21–26

[56] References Cited

U.S. PATENT DOCUMENTS

| | | | |
|---|---|---|---|
| 2,742,549 | 4/1956 | Peters | 439/412 |
| 2,758,280 | 5/1956 | More | 439/412 |
| 3,141,717 | 7/1964 | Olsson et al. | 439/381 |
| 3,372,361 | 3/1968 | Wengen | 439/412 |
| 4,723,916 | 2/1988 | Fusselman et al. | 439/92 |
| 4,960,388 | 10/1990 | Frantz et al. | 439/404 |
| 4,960,389 | 10/1990 | Frantz et al. | 439/404 |
| 4,972,575 | 11/1990 | Frantz et al. | 29/858 |
| 5,273,443 | 12/1993 | Frantz et al. | 439/595 |
| 5,417,585 | 5/1995 | Morin et al. | 439/488 |

*Primary Examiner*—P. Austin Bradley
*Assistant Examiner*—Tho D. Ta
*Attorney, Agent, or Firm*—St. Onge Steward Johnston & Reens LLC

[57] ABSTRACT

A phone jack connector is described with which a multiple conductor cable can be connected to the lead frame inside the phone jack using insulation displacement contacts (IDCs) but without the use of a special tool. A yoke assembly for receiving the cable aligns the individual conductors with IDC's located on a conductor assembly having a lead frame electrically connected to the IDC's. A screw thread is located on a wall on the conductor assembly and can be engaged by a cable nut that fits around the yoke assembly. When the nut is manually rotated it forces the yoke assembly against the IDC's and thereby causes an electrical contact to be made between the conductors and the lead frame of the phone jack.

5 Claims, 3 Drawing Sheets

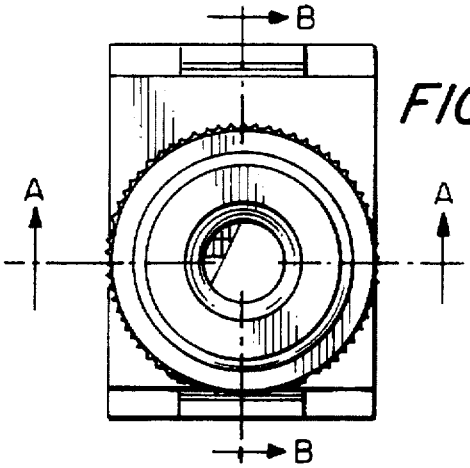
FIG. 3
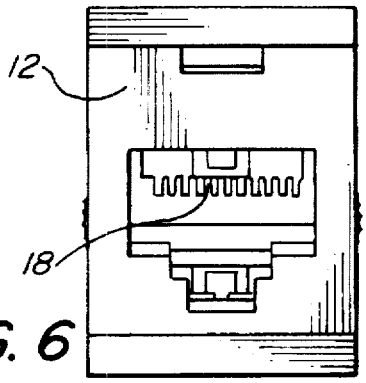
FIG. 6
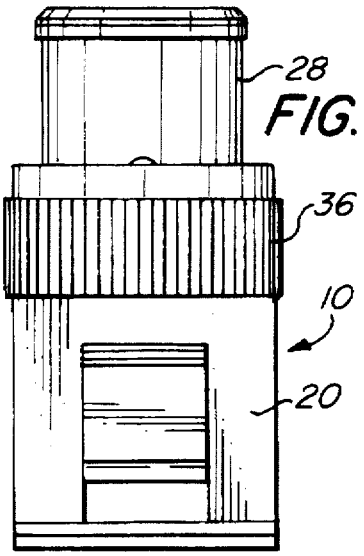
FIG. 4
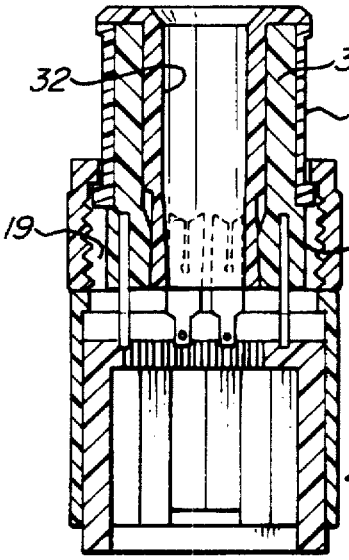
FIG. 7
FIG. 5
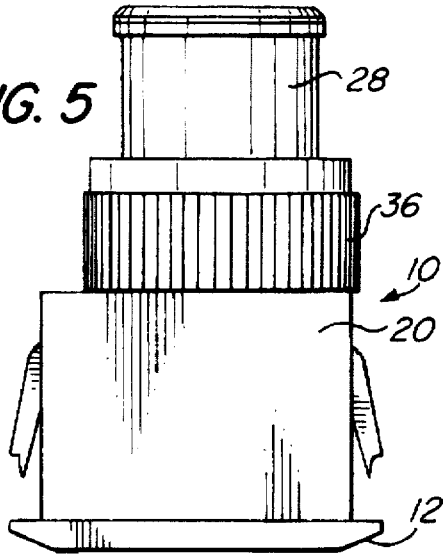
FIG. 8
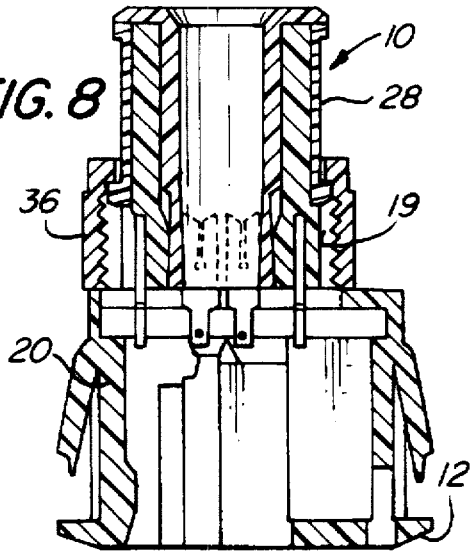

TOOL-LESS PHONE JACK-TO-CABLE CONNECTOR

This invention relates to a connection system for coupling a telephone cable to a phone jack.

BACKGROUND OF THE INVENTION

Single cable push-on type connectors are known in the art. See for example U.S. Pat. Nos. 4,723,916; 4,960,388; 4,960,389 and 4,972,575.

These prior art devices still require a tool to make a connection.

SUMMARY OF THE INVENTION

With a connector in accordance with the invention a tool-less phone jack-to-cable connector is provided by employing a conductor assembly. The conductor assembly includes a lead frame as is typically used in phone jacks. The lead frame is connected to insulation displacement contacts (IDC). A yoke assembly provides a fixed alignment of insulated conductors of a phone cable relative to the IDC's. A cable nut having a screw thread which meshes with a screw thread located either on the conductor assembly or on a housing which encloses it enables one to manually achieve an electrical connection between the conductors and the IDC's.

It is, therefore, an object of the invention to provide a tool-less connector for phone jacks that is convenient to apply and use.

These and other object and advantages of the invention can be understood from the following description of the invention in conjunction with the drawings.

BRIEF DESCRIPTION OF THE DRAWINGS

FIGS. 3, 4, 5, and 6 are respectively top, front, right and bottom views of the phone jack shown in FIG. 1; and FIGS. 7 and 8 are section views taken along the lines A—A and B—B respectively in FIG. 3.

DETAILED DESCRIPTION OF EMBODIMENTS

Figure 1:
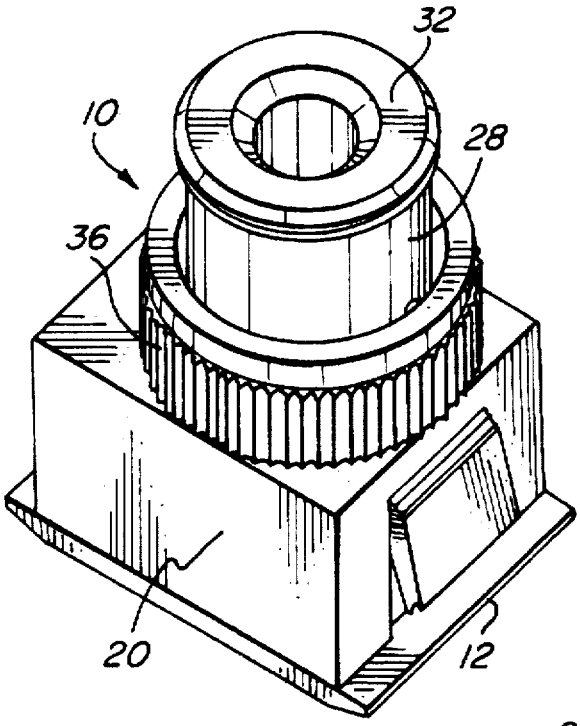
FIG. 1 is a perspective view of an assembled phone jack in accordance with the invention.

With reference to FIGS. 1 through 8 a phone jack to cable connector 10 is shown that can be assembled without the use of a special tool. The phone jack connector includes an upper housing 12 into which fits a conductor assembly 13 formed with a pc-board 14 having a plurality of surrounding insulation displacement contacts (IDC's) 16. In addition the conductor assembly 13 has a lead frame 18 composed of wires used to enable one to make a phone jack connection in a manner well known in the art. The lead frame 18 is electrically connected to the IDC's 16 with conductors, not shown, on the pc board 14.

Figure 2:
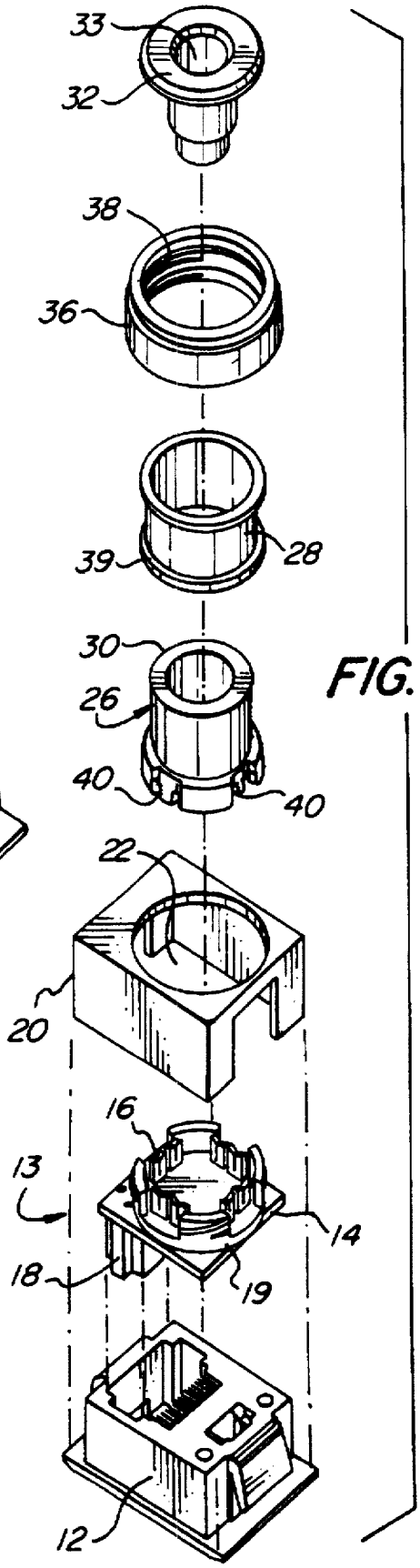
FIG. 2 is an exploded view of various components used in the phone jack of FIG. 1.
Figure 2A:
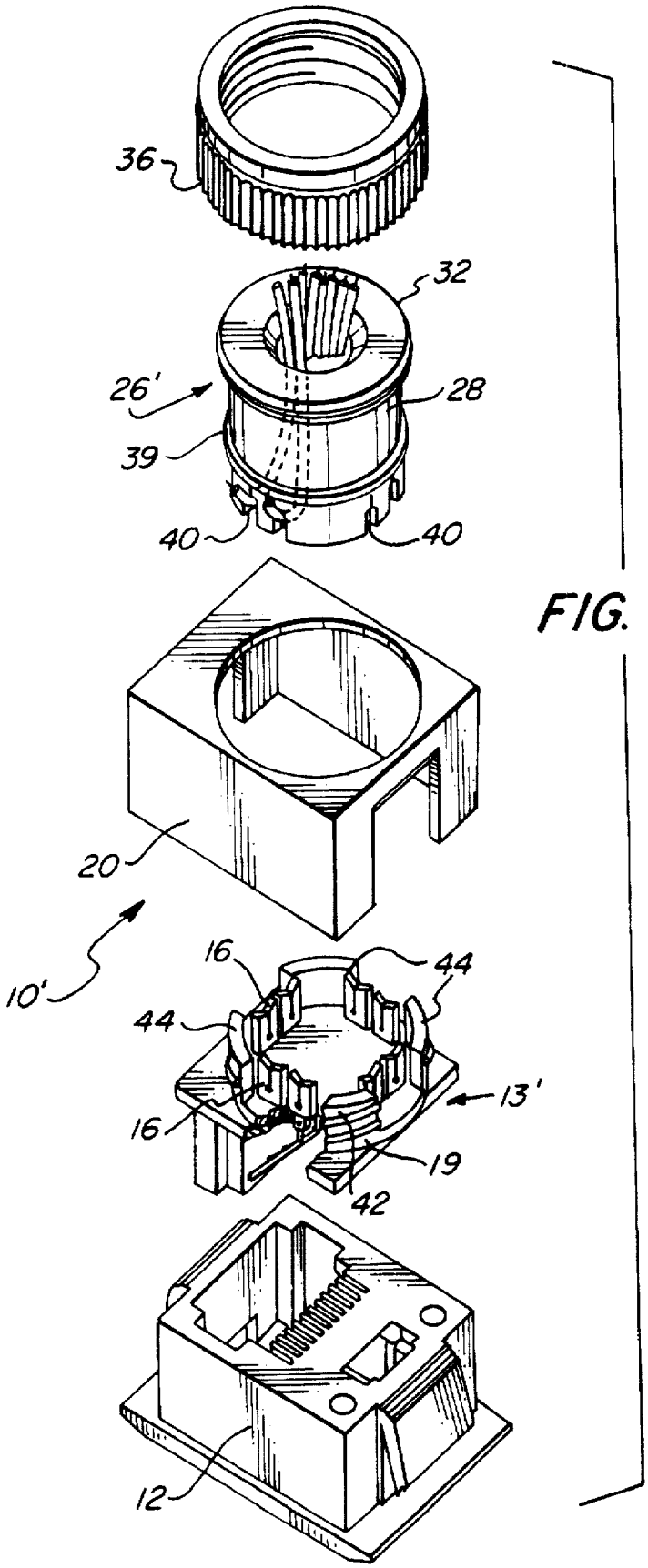
FIG. 2A is an exploded view of a modified version of the embodiment shown in FIG. 1.

A screw thread 19 is either placed on the bottom housing 22 but preferably on the pc-board 14 side that has the IDC's 16 as more clearly shown in FIG. 2A. A bottom housing 20 is provided and fits over the conductor assembly 13 and snap fits to the upper housing 12 to capture the lead frame 18 and its connected assembly 13 within the housing formed by the upper and lower housings 12, 20. The bottom housing 20 has an opening 22 through which the IDC's 16 on the pc board 14 are exposed so that connections to them can be made.

A wire yoke 26 is used to receive and align the insulated conductors in the phone cable, not shown, and to which the jack's IDC's are to be connected. The wire yoke has a collar 28 that fits around a cylindrical extension 30 to enclose conductor ends and a cable grommet 32 having a through bore 33 through which the phone cable, to which a connection is to be made, is fed.

A cable nut 36 fits around the collar 28 and engages a lower annular edge 38 on the collar 28. The cable nut 36 has an internal screw thread 38 which meshes with the screw thread 19. A seating edge 39 is located on the yoke assembly or on the collar 28 to enable the nut to force the yoke assembly towards the IDC's 16. Hence, when a phone cable is inserted and properly aligned, the conductor ends are folded over an axial end of the wire yoke 26 so that the conductors with their insulation are each in a slot 40 and in operative alignment with an IDC. The application of the cable nut 36 to the screw thread 19 enable one to exert sufficient closing force to push the conductors into the IDC's and thus make a connection with the phone jack lead frame 18.

FIG. 2A shows a similar type of phone jack connector 10' but in which a yoke assembly 26' includes the cable nut 36 and cable grommet 32. Note the use of the wire slots 40 into which the conductor ends are folded. The screw thread 19 is formed on radially outer surfaces 42 of surrounding wall segments 44 which together form an attachment wall. The wall segments are connected to the pc board 14.

With a phone jack in accordance with the invention connections to conductors in a cable can be manually made without having to use special tooling. The force needed to cause a proper insertion of conductor ends into an IDC is provided by the cam action from the rotational tightening of the nut 36 when it engages the thread 19.

Having thus described several embodiments in accordance with the invention variations from what is shown can be implemented without departing from the scope of the invention. For example, the housing formed by the components 12 and 20 can be shaped to fit inside an appropriate plate or other housing for attachment to a receptacle.

What is claimed is:

1. A telephone jack connector, comprising:

a lead frame assembly having a lead frame and a wall with a screw thread and having a plurality of insulation displacement contacts surrounded by the wall and in electrical contact with the lead frame;

a wire yoke assembly having a through bore for receiving a multiple insulated conductor phone cable so that ends of the cable can be folded over an end of the wire yoke assembly in alignment with the insulation displacement contacts on the lead frame assembly; and a cable nut having a screw thread that meshes with the thread on the lead frame assembly and fits in clamping relationship with the wire yoke assembly so that when the cable nut is rotated it forces conductor ends when these are folded over the wire yoke assembly into said insulation displacement contacts for electrical contact therewith.

2. The phone jack connector as claimed in claim 1 wherein said wire yoke assembly comprises a wire yoke having a through bore, a collar sized to surround the wire yoke and a cable grommet sized to fit inside the through bore of the wire yoke.

3. A telephone jack connector, comprising:

a jack housing having a first opening and a lead frame assembly located inside the jack housing, said lead frame assembly having a wall with a screw thread positioned in alignment with the opening and having a plurality of insulation displacement contacts surrounded by the wall and in electrical contact with the lead frame assembly;

a wire yoke assembly having a through bore for receiving a multiple insulated conductor phone cable having ends so that ends of the cable can be folded over an end of the wire yoke assembly in alignment with the insulation displacement contacts on the lead frame assembly; and a cable nut having a screw thread that meshes with the thread on the lead frame assembly and fits in clamping relationship with the wire yoke assembly so that when the cable nut is rotated it forces the conductor ends folded over the wire yoke assembly into said insulation displacement contacts for electrical contact therewith.

4. The phone jack as claimed in claim 3 wherein the housing comprises an upper housing and a lower housing which interfit with each other to capture the conductor assembly.

5. The phone jack connector as claimed in claim 4 wherein said jack housing has a second opening located opposite said first opening to receive a phone plug that is adapted to electrically engage the lead frame assembly.

* * * * *